US010383422B2

(12) United States Patent
Law et al.

(10) Patent No.: US 10,383,422 B2
(45) Date of Patent: Aug. 20, 2019

(54) HAIR CARE DEVICE

(71) Applicant: KONINKLIJKE PHILIPS N.V., Eindhoven (NL)

(72) Inventors: Chak Yuen Law, Eindhoven (NL); Cho Woo, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/746,058

(22) PCT Filed: Jul. 12, 2016

(86) PCT No.: PCT/EP2016/066463
§ 371 (c)(1),
(2) Date: Jan. 19, 2018

(87) PCT Pub. No.: WO2017/016865
PCT Pub. Date: Feb. 2, 2017

(65) Prior Publication Data

US 2018/0206610 A1 Jul. 26, 2018

(30) Foreign Application Priority Data

Jul. 24, 2015 (EP) ..... 15178292

(51) Int. Cl.
*A45D 20/12* (2006.01)

(52) U.S. Cl.
CPC ..... *A45D 20/122* (2013.01); *A45D 20/12* (2013.01)

(58) Field of Classification Search
CPC ..... A45D 20/122; A45D 20/12
(Continued)

(56) References Cited

U.S. PATENT DOCUMENTS 3,145,642 A * 8/1964 Radcliff ..... F24F 13/15 454/315
3,345,930 A * 10/1967 Ammons ..... F24F 1/02 454/315

(Continued)

FOREIGN PATENT DOCUMENTS

CN 2636694 Y 9/2004
CN 201557699 U 8/2010

(Continued)

*Primary Examiner* — Gregory L Huson
*Assistant Examiner* — Frances F. Hamilton

(57) ABSTRACT

An air outlet grill for use on a hair care device comprises a plurality of concentric and tilted flow guide surfaces (2), a cross section of the flow guide surfaces (2) having a curved shape that diverges in an air flow direction. Preferably, tilt angles between the flow guide surfaces (2) are designed such that an air inlet area of the air outlet grill is larger than an air outlet area of the air outlet grill, so as to increase air speed. Preferably, a middle flow guide surface has a smaller height compared to at least one other flow guide surface, so as to increase an area for air to pass through at a middle part of the air outlet grill. Preferably, a leading edge of at least one of the flow guide surfaces (2) is tangent to the air flow direction while a trailing edge of the flow guide surfaces diverges from the air flow direction. Preferably, a cross-section profile of at least one of the flow guide surfaces (2) is airfoil shaped such that a thickness of the leading edge is smaller than a thickness of the trailing edge in the air flow direction.

4 Claims, 1 Drawing Sheet

(58) Field of Classification Search
USPC ..... 454/339
See application file for complete search history.

(56) References Cited

U.S. PATENT DOCUMENTS

| | | | | | |
|---|---|---|---|---|---|
| 4,142,456 | A * | 3/1979 | Locker | F24F 13/06 | 239/502 |
| 4,330,047 | A * | 5/1982 | Ruspa | F24F 13/08 | 181/224 |
| 4,607,565 | A * | 8/1986 | Sugawara | F24F 13/075 | 454/314 |
| 4,610,196 | A * | 9/1986 | Kern | B60H 1/3435 | 454/127 |
| 4,924,602 | A | 5/1990 | Ohlsen | | |
| 5,060,398 | A * | 10/1991 | Wolens | A45D 20/122 | 132/271 |
| 5,392,528 | A * | 2/1995 | McDougall | A45D 20/124 | 239/101 |
| 5,471,763 | A * | 12/1995 | McArthur | A45D 20/124 | 34/96 |
| D393,926 | S * | 4/1998 | Kling | D28/18 | |
| 5,861,585 | A * | 1/1999 | Van Every | G01M 9/04 | 181/224 |
| 6,199,295 | B1 * | 3/2001 | Smal | A45D 20/122 | 34/98 |
| 6,216,363 | B1 | 4/2001 | Swansen | | |
| 6,957,500 | B2 * | 10/2005 | McCambridge | A45D 20/12 | 239/291 |
| 7,165,341 | B2 * | 1/2007 | Saida | A45D 20/10 | 34/98 |
| 7,334,988 | B2 | 2/2008 | Horng | | |
| 2006/0196075 | A1 * | 9/2006 | Santhouse | A45D 20/10 | 34/96 |
| 2006/0254073 | A1 * | 11/2006 | Zhen | A45D 20/10 | 34/96 |
| 2008/0227381 | A1 * | 9/2008 | Avedon | F04D 25/088 | 454/230 |
| 2008/0271337 | A1 * | 11/2008 | Chan | A45D 20/122 | 34/98 |
| 2010/0124876 | A1 * | 5/2010 | Yu | B60H 1/3428 | 454/155 |
| 2012/0311882 | A1 * | 12/2012 | Yoe | A45D 20/12 | 34/98 |
| 2016/0288625 | A1 * | 10/2016 | Uhlenbusch | B60H 1/3407 | |

FOREIGN PATENT DOCUMENTS

| | | | | | |
|---|---|---|---|---|---|
| CN | 203986602 | U | 12/2014 | | |
| CN | 104473416 | A | 4/2015 | | |
| EP | 0439781 | A1 * | 8/1991 | A45D 20/122 | |
| EP | 0784947 | A1 | 7/1997 | | |
| EP | 0884542 | A1 * | 12/1998 | F24F 1/58 | |
| FR | 2592747 | B1 * | 3/1988 | H02M 3/337 | |
| JP | 58131382 | A | 8/1983 | | |
| JP | 07116016 | A | 5/1995 | | |
| JP | 10332190 | A | 12/1998 | | |
| JP | 11223378 | A | 8/1999 | | |
| WO | 2012012934 | A1 | 2/2012 | | |
| WO | WO 2012012934 | A1 * | 2/2012 | A45D 20/122 | |

* cited by examiner

HAIR CARE DEVICE

This application is the U.S. National Phase application under 35 U.S.C. § 371 of International Application No. PCT/EP2016/066463, filed on Jul. 12, 2016, which claims the benefit of International Application No. 15178292.7 filed on Jul. 24, 2015. These applications are hereby incorporated by reference herein.

FIELD OF THE INVENTION

The invention relates to a hair care device, and in particular to an air outlet grill for use on a hair care device.

BACKGROUND OF THE INVENTION

WO 2012/012934 discloses an accessory for a hair treatment apparatus. The accessory comprises a housing, an airflow guiding member with a longitudinal axis, and a control knob. The airflow guiding member is made of an elastic material (e.g. silicone rubber). The control knob makes the airflow guiding member move between a concentrating configuration and a diffusing configuration. When the airflow guiding member is in the concentrating configuration, air entering the accessory is directed by the airflow guiding member to leave the accessory in a direction towards the longitudinal axis of the airflow guiding member, and when the airflow guiding member is in the diffusing configuration, air entering the accessory is directed by the airflow guiding member to leave the accessory in a direction away from the longitudinal axis of the airflow guiding member.

CN201557699U discloses an electric hair dryer comprising a shell, wherein the shell is provided with an air inlet and an air outlet and characterized in that the air outlet is equipped with an air guiding device comprising an air guiding ring and a plurality of air guiding gratings and the air guiding gratings divided into two groups are securely and fixedly mounted in the air guiding ring. The electric hair dryer is structurally characterized in that the air guiding device comprising the air guiding ring and the air guiding gratings is mounted at the air outlet of the electric hair dryer and the air guiding gratings divided into two groups are securely and fixedly mounted in the air guiding ring, the air blown out by the electric hair dryer can be fully dispersed by the air guiding device, thus greatly enlarging the blowing area, allowing the air to come into fully contact with the hair and improving the hair-drying efficiency.

CN2636694 discloses an air outlet net of an electric dryer. The air outlet net consists of an inner cone shaped cylinder and an outer cone shaped cylinder on the same axle, wherein the inner cone shaped cylinder is fixed inside the outer cone shaped cylinder through a strengthening rib, and the outer surface of the outer cone shaped cylinder is provided with a plurality of strengthening ribs, an anti-rotation positioning notch is arranged on the edge of one end of an air inlet. The air blown out by the hair dryer is more concentrated, compared with the existing air outlet net, the speed and the temperature of the air are both improved, and the hair-drying effect is good. By adopting two cylinders on the same axle, the strength of the cylinders are better, and the shock resistant performance is fine, meanwhile, compared with the air outlet net with one cylinder, the diameter of the air cylinder of the hair dryer can be larger.

SUMMARY OF THE INVENTION

It is, inter alia, an object of the invention to provide an improved hair care device. The invention is defined by the independent claims. Advantageous embodiments are defined in the dependent claims.

The hair care device in accordance with the present invention has a new 3D contour air outlet grill having a plurality of concentric and tilted flow guide surfaces, a cross section of the flow guide surfaces having a curved shape that diverges in an air flow direction, which flow guide surfaces will provide larger air spread of the air passing through the air blower, as the air is spread into more dimensions than in the prior art. The 3D contour air outlet grill could increase the drying rate of an air blower which is key user benefit in case of the air blower is a hair dryer or air-styler. Preferably, tilt angles between the flow guide surfaces are designed such that an air inlet area of the air outlet grill is larger than an air outlet area of the air outlet grill, so as to increase air speed. Preferably, a middle flow guide surface has a smaller height compared to at least one other flow guide surface, so as to increase an area for air to pass through at a middle part of the air outlet grill. Preferably, a leading edge of at least one of the flow guide surfaces is tangent to the air flow direction while a trailing edge of the flow guide surfaces diverges from the air flow direction. Preferably, a cross-section profile of at least one of the flow guide surfaces is airfoil shaped such that a thickness of the leading edge is smaller than a thickness of the trailing edge in the air flow direction.

These and other aspects of the invention will be apparent from and elucidated with reference to the embodiments described hereinafter.

DESCRIPTION OF EMBODIMENTS

Figure 1:
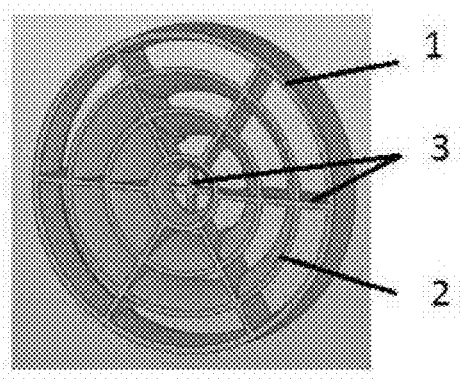
FIGS. 1 and 2 show an embodiment of an air outlet grill in accordance with the present invention.
Figure 2:
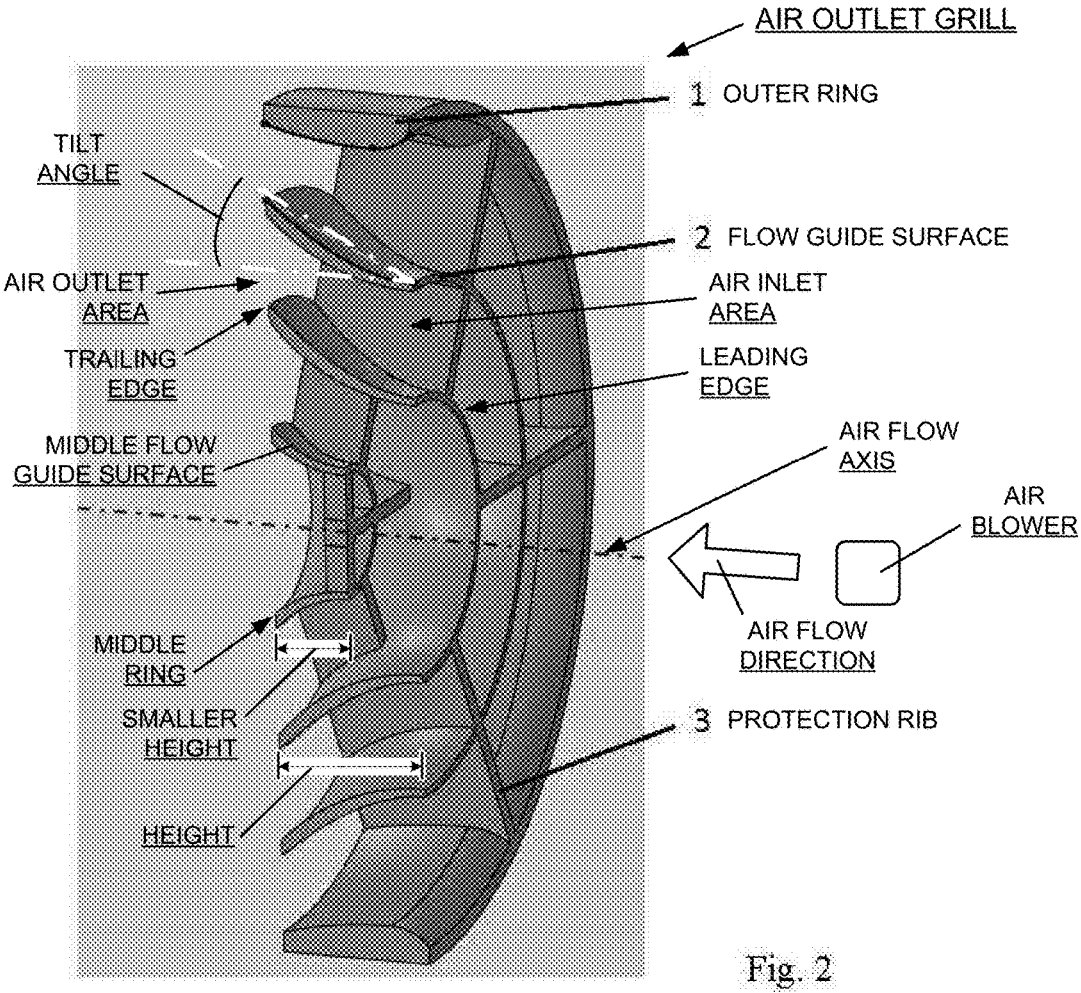

FIGS. 1 and 2 depict a 3D contour air outlet grill in accordance with the present invention. The air outlet grill has an outer ring 1, flow guide surfaces 2 and protection ribs 3.

Outer ring 1 provides support and a mounting method to the flow guide surfaces 2. However the air outlet grill does not necessary to be provided with an outer ring. It is also conceivable that the flow guide surfaces 2 may in some way couple with an inner surface of the air blower housing, for example by means of a circumferential groove that houses part of distal end of the flow guide surfaces 2. The outer ring 1 is the main body to fit the flow guide surfaces 2 and is designed to match with the air blower by means of snap-fitting, gluing, ultra-sonic welding, bayonet mounting, screws or combination of them.

The profile of the flow guide surfaces 2 is specially designed to be curved and has a tilt angle with respect to airflow axis. There are opening areas between the flow guide surfaces 2 to allow air movement across the air outlet grill. When air is passing through the space between flow guide surfaces 2, the air will be deflected more outwardly. Tilt angles between the flow guide surfaces 2 are designed such that the air inlet area is larger than an air outlet area, so that the air speed will be increased. These effects will increase the airflow coverage area. The flow guide surfaces 2 have a special profile designed to divert axial airflow to circumferential airflow and provide openings to allow air to pass through.

The number of flow guide surfaces 2 could be odd or even.

The rings of flow guide surfaces could be circular or oval, and they are concentric.

Spaces between the flow guide surfaces 2 could be designed to meet regulatory requirements to avoid live part accessibility. It is also conceivable that if an additional safety feature is provided, the space between the flow guide surfaces 2 could be larger.

Protection ribs 3 provides structure and mechanical protection to flow guide surfaces 2 and also form a barrier to meet regulatory requirements to avoid live part accessibility. It is also conceivable that if an additional safety feature is provided, the central protection rib could be removed.

The air outlet grill of the present invention will increase the hot air coverage area and increase drying rate. The 3D contour air outlet grill could replace a normal air outlet grill or as an attachment to attach on a normal air blower.

FIG. 2 illustrates that the flow guide surface rings 2 are arranged in steps, with the middle ring lower than others. It is intended to increase the area for air to pass through at a middle part of the air outlet grill. FIG. 2 also illustrates that the flow guide surface rings 2 are not arranged in parallel, but are curved. The cross-section profile of the flow guide surface ring 2 is airfoil shaped such that the thickness of the leading edge is smaller than the thickness of the trailing edge. Herein, the leading edge of flow guide surfaces means the edge that is first to contact with incoming airflow. The trailing edge means the edge at which the airflow exits from the flow guide surface. The leading edge of the flow guide surfaces is tangent to the air flow direction while the trailing edge of the flow guide surfaces diverges from the air flow direction. In FIG. 2, the air flow goes from right to left.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements.

The invention claimed is:

1. A hair care device provided with an air blower and an air outlet grill, wherein said air blower is configured to provide air along an air flow axis in an air flow direction through the air outlet grill, said air outlet grill comprising a plurality of concentric and tilted flow guide surfaces arranged in circular or oval rings, wherein a cross section of the flow guide surfaces, extending between a leading edge and a trailing edge of a respective flow guide surface along the air flow direction, has a curved shape beginning at the leading edge, which is tangent to a line parallel to the air flow axis, and ending at the trailing edge, which curves in a manner that diverges away from the air flow axis in the air flow direction, said cross section of the flow guide surfaces being taken with reference to an axial plane parallel to the air flow direction, wherein said concentric and tilted flow guide surfaces of the air outlet grill are shaped such that at least one air inlet area between a pair of immediately adjacent ones of the flow guide surfaces of the air outlet grill is larger than an air outlet area between said pair of immediately adjacent ones of the flow guide surfaces of the air outlet grill so as to increase air speed between said pair of immediately adjacent ones of the flow guide surfaces of the air outlet grill.

2. The hair care device as claimed in claim 1, wherein a middle flow guide surface of the plurality of concentric and tilted flow guide surfaces has a smaller height dimension along the air flow axis compared to a height dimension along the air flow axis of at least one other flow guide surface of the plurality of concentric and tilted flow guide surfaces, wherein an air inlet area, formed by the middle flow guide surface and an immediately adjacent flow guide surface at a leading edge side of the respective flow guide surfaces, for air to pass through at a middle part of the air outlet grill, is larger than a second air inlet area, formed by adjacent flow guide surfaces at a leading edge side of the respective flow guide surfaces, different from the middle flow guide surface and the immediately adjacent flow guide surface, for air to pass through a corresponding portion of the air outlet grill.

3. The hair care device as claimed in claim 1, wherein a leading edge of at least one of the flow guide surfaces is parallel to the air flow axis in the air flow direction while a trailing edge of the respective at least one of the flow guide surfaces diverges at an angle away from the air flow axis in the air flow direction, wherein the leading edge of a respective flow guide surface comprises an edge that is first to contact incoming airflow, and the trailing edge of the respective flow guide surface comprises an edge at which the airflow exits away from the respective flow guide surface.

4. The hair care device as claimed in claim 1, wherein a cross-section profile of at least one of the flow guide surfaces is airfoil shaped such that a thickness of a respective leading edge is smaller than a thickness of a respective trailing edge in the air flow direction, wherein the leading edge of a respective flow guide surface comprises an edge that is first to contact incoming airflow, and the trailing edge of the respective flow guide surface comprises an edge at which the airflow exits away from the respective flow guide surface.

* * * * *